United States Patent [19]

Talley

[11] 4,236,603

[45] Dec. 2, 1980

[54] LADDER LEVELING DEVICE

[76] Inventor: Charles D. Talley, 7905 Joel, Affton, Mo. 63123

[21] Appl. No.: 959,098

[22] Filed: Nov. 9, 1978

[51] Int. Cl.[3] ..... E06C 7/44

[52] U.S. Cl. ..... 182/204

[58] Field of Search ..... 182/201-205, 182/184, 178

[56] References Cited

U.S. PATENT DOCUMENTS

| | | | |
|---|---|---|---|
| 1,246,709 | 11/1917 | Brown | 182/204 |
| 2,245,306 | 6/1941 | Smith | 182/203 |
| 2,581,782 | 1/1952 | Anderson | 182/204 |
| 3,394,774 | 7/1968 | Lanier | 182/204 |
| 3,752,262 | 8/1973 | Helms | 182/178 |

FOREIGN PATENT DOCUMENTS

| | | | |
|---|---|---|---|
| 265938 | 2/1963 | Australia | 182/204 |
| 285440 | 12/1952 | Switzerland | 182/204 |
| 901224 | 7/1962 | United Kingdom | 182/205 |

*Primary Examiner*—Reinaldo P. Machado
*Attorney, Agent, or Firm*—Haverstock, Garrett & Roberts

[57] ABSTRACT

An adjustable device for leveling a ladder having one or more bores through at least one of the stiles thereof, comprising an elongated channel shaped ladder extending member independently cooperatively engagable with one of the stiles of a ladder and being slidable thereon, the channel shaped member having two opposite side walls and a connecting wall extending therebetween, a plurality of spaced longitudinally disposed apertures in each opposite side wall, the apertures in one side wall corresponding to and being in lateral alignment with the respective apertures in the other side wall to define aperture pairs, each aperture pair being able to be positioned in alignment with a selected one of the bores through the ladder stile when the channel shaped member is engaged therewith, a pin member adapted to pass through the selected ladder stile bore and the aperture pair in alignment therewith to hold the leveling device in the desired position with respect to the selected ladder stile, and means attached to the channel shaped member and extending beyond the ladder stile for engaging a surface on which the ladder is supported during use.

12 Claims, 6 Drawing Figures

LADDER LEVELING DEVICE

The present invention relates to a ladder leveling device, and more particularly to a ladder leveling device that may be employed with a ladder having one or more bores through one or more of the stiles thereof, said leveling device including means cooperatively engagable with a selected one of the stiles, and having aperture means thereon registrable with a selected aperture in the stile, and means cooperatively engagable with the registered apertures to retain the leveling device in a selected position of adjustment thereon.

The problem of ladder utilization on uneven surfaces has been long recognized and a variety of devices, including those described in U.S. Pat. Nos. 1,560,978; 2,306,797; 3,998,293; 4,090,586, and 4,091,893 have been devised and used in an attempt to provide convenient, efficient, and easy-to-use ladder leveling devices to permit safe and trouble-free use of ladders especially on uneven or sloping terrain. All of the known devices, however, have shortcomings and disadvantages. Several of the known devices, such as those described in U.S. Pat. Nos. 1,560,978 and 2,306,797 include components which are permanently or semi-permanently mounted upon or attached to the ladder, and they require other ladder extending components which are engagable with the mounted or attached components to permit leveling of the ladder in such a manner as to result in localization of relatively high stress and shear forces upon the connecting members with the result of making ladders so equipped relatively unsafe to use. Furthermore, not only is the use of permanently or semi-permanently mounted or attached components undesirable because it adds unnecessary weight to the ladder, but it is also undesirable because it destroys the natural balance, makes handling and transporting of the ladder awkward and burdensome, and proves especially irritating when the leveling means are not needed. Still further, the known devices have often included bolts and other locking means which extend into the inner area of the ladder where they obstruct normal usage of the rungs, interfere with proper use thereof, and present a safety problem. Also, with the known constructions, the continued application of stress and shear forces at the localized high stress areas results in more rapid deterioration of the members involved and a greater likelihood of failure of the connected members.

Other devices, such as that described in U.S. Pat. No. 3,998,293, while not requiring permanently or semi-permanently mounted components on the ladder, have suffered from other disadvantages and shortcomings, and have likewise failed to overcome the problem of localization of the stress and shear forces on the connected members. Additionally, the patented device requires the use of connected members that extend completely through the inner area of the ladder, and they require locking means which include wing-nuts or bolts therewith, and these have presented obstructions particularly in the areas where the user places his feet thereby constituting a safety hazards, and making adjustment of the leveling device difficult and time consuming. This is especially so as such devices require the removal of locking means prior to and the replacement thereof after repositioning of the leveling device. The known leveling devices are also time consuming to use and adjust and are fairly complicated and expensive to make.

The present invention overcomes these and other shortcomings and disadvantages, and teaches the construction and use of a ladder leveling device which is safe and easy to use and relatively inexpensive to make. The present device can be used on any ladder having spaced stiles with opposite ends and a bore through at least one of the stiles adjacent to an end thereof, and the device includes a channel shaped member with a ground engaging end portion, the channel shaped member having opposite side walls and a connecting wall extending therebetween for slidably embracing one of the ladder stiles, each opposite side wall of the channel shaped member being provided with at least two longitudinally spaced apertures therethrough, the apertures in one side wall being in lateral alignment with corresponding apertures in the opposite side wall to form aperture pairs, the aperture pairs being positioned in the side walls so as to be registrable with a selected bore through the stile when the channel shaped member is mounted thereon, a pin insertable through one of the aperture pairs and through the bore in registration therewith, to hold the channel shaped member in the desired position on the stile. The present device thus better distributes the stress and shear forces on the connected members and prevents localization thereof. Furthermore, the positioning of the apertures and the extension of the pin member from front-to-back in the ladder stile eliminates obstructions and potential safety hazards from the interior area of the ladder occupied by the user's feet and legs as he uses the ladder and so provides a safer working environment. Moreover, the present construction eliminates the necessity of providing locking means with the connecting member to achieve stability of the leveling device-ladder combination, thereby permitting adjustments to be made more quickly and easily, although locking means may nevertheless still be employed to provide increased stability and as a further safety feature, if desired.

It is therefore a principal object of the present invention to provide improved means for leveling a ladder by providing adjustable stile extension means therefor.

Another object is to provide adjustable means for leveling a ladder which need not be a permanent part of the ladder.

Another object is to provide a ladder device which does not localize stress and shear forces, thereby increasing the safety of the device.

Another object is to provide a relatively safe and simple to use means for leveling a ladder.

Another object is to provide adjustable means for leveling ladders which do not substantially weaken the ladder and do not interfere with normal usage thereof.

Another object is to provide a device for leveling a ladder which can be quickly and easily adjusted.

Another object is to provide a device for use in leveling ladders which can be used in conjunction with many different ladder constructions.

Another object is to provide a device for leveling a ladder which can be mounted on either ladder stile without requiring modification of the device.

Another object is to provide means for leveling a ladder which requires minimum change to the ladder on which they are used.

Another object is to make it safer to use a ladder on uneven or sloping surfaces.

Another object is to provide a ladder leveling device which can be retained on the ladder when not in use to prevent loss thereof and without interferring with normal handling thereof.

Another object is to provide an improved ladder leveling device which may include resilient high friction ground engaging means.

Another object is to provide an adjustable ground engaging means that can be mounted on one ladder stile and adjusted so that the ladder can be supported in a vertical condition regardless of the direction of the slope or unevenness of the supporting surface.

These and other objects and advantages of the present invention will be readily appreciated as the same become better understood by reference to the following detailed description in connection with the accompanying drawing wherein several preferred embodiments are shown, and wherein like reference numbers designate like parts, and wherein.

Figure 1:
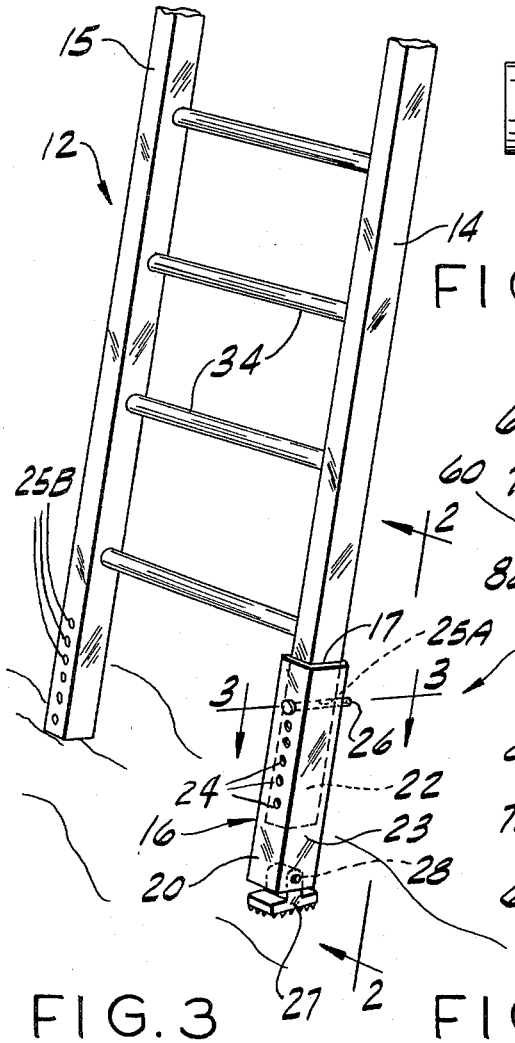
FIG. 1 is a perspective view of a ladder having a preferred embodiment of the subject ladder leveling device mounted thereon.

Referring to the drawing more particularly by reference numbers, number 10 refers generally to a ladder leveling device shown mounted on a ladder 12 and is designed to be used on existing ladders commonly found in the home and business. The device can be mounted on either upright or stile member 14 or 15 of the ladder 12 as will be explained. The device includes an elongated channel shaped member 16 which defines a channel 17 therein, and the member 16 has opposite side walls 20 and 22 and a connecting wall 23 extending therebetween. A plurality of spaced apertures, such as apertures 24 and 24A (as most clearly shown in FIG. 3), are positioned in the respective opposite side walls 20 and 22 of the channel shaped member 16 and the respective apertures in the opposite side walls are in alignment to define a plurality of aligned aperture pairs.

The channel shaped member 16 is shaped and dimensioned to be slid onto and be engagable with either of the stiles 14 or 15 of the ladder 12, and is shown in FIG. 1 positioned on the stile 14, such that the stile 14 extends through the channel 17. One or both of the stiles 14 and 15 has one or more spaced apertures or bores therethrough such as the bores 25A in stile 14 and bores 25B through the stile 15. The bores 25A and 25B extend transversely through the respective stiles from front-to-back, as shown and any one of the bores can be selectively placed in registration with a selected pair of the apertures, such as aperture 24 and 24A, in leveling device 10 (as best shown in FIG. 3). This is accomplished by appropriate positioning of the leveling device 10 on the desired stile 14 or 15. This in turn will depend on the amount of unevenness or slope of the surface on which the ladder is to be supported. When properly positioned to compensate for the unevenness or slope a pin member 26 is passed through one of the aligned aperture pairs 24 and 24A and the selected stile bore 25A as shown in FIGS. 1–3 to attach the member 16 to the ladder 12 and to prevent relative movement therebetween.

A ground engaging foot such as resiliently cushioned high friction ground engaging foot 27 is preferably, though not necessarily, attached to one end of the channel shaped member 16 and extends beyond the lower end of the stile 14 on which the device is installed to engage the ground or other surface on which the ladder is to be positioned. The foot 27 may take any of a variety of forms but is shown in FIGS. 1 and 2 as including the member 27 which is pivotally attached at 28 to one end of the channel member 16. The foot 27 is also shown having cleat-like projections 29 to better engage the ground and prevent movement or slippage when the ladder is being used. It is apparent that the device 10 can be used on either stile 14 or 15 depending on which one needs to be extended to compensate for unevenness in the support surface and to maintain the ladder in as nearly an upright position as possible. It is also possible to mount the subject device on a shortened stile so that its foot 27 can be adjusted to extend in either direction relative to the end of the opposite stile to compensate for ground slope in either direction. This requires some modification in the ladder itself and may be desirable in some cases and not in others.

Figure 5:
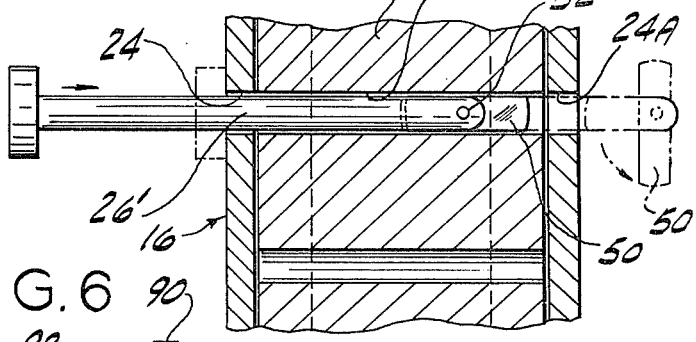
FIG. 5 is a cross-sectional side view of the device showing a modified form of pin means for use therewith.
Figure 2:
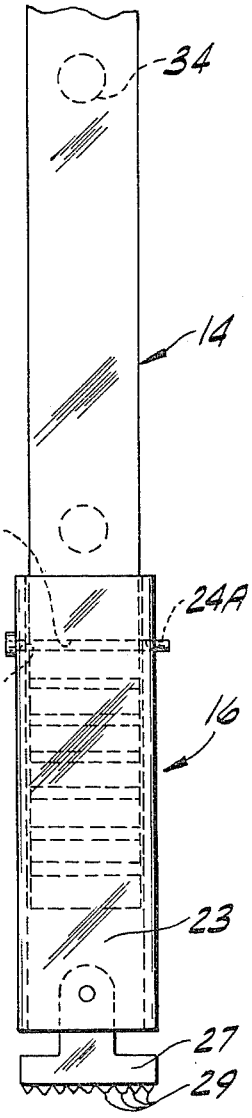
FIG. 2 is a fragmentary side elevational view of the ladder and ladder leveling device taken on line 2—2 of FIG. 1.
Figure 3:
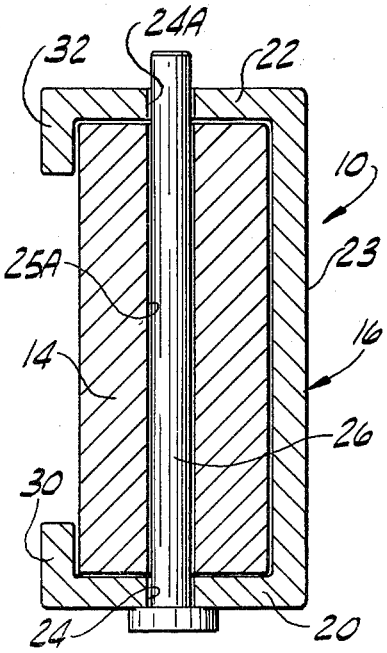
FIG. 3 is an enlarged cross-sectional view taken on line 3—3 of FIG. 1.

As best shown in FIGS. 2 and 3, the pin member 26 is of sufficient length to pass through the aperture 24 in wall 20, the bore 25A in stile 14 and the aperture 24A in the wall 22, and therebeyond. If desired, the pin member 26 may be threaded or otherwise configured to allow for a locking means of some sort, such as a nut or cotter key. It is also envisioned, as shown in FIG. 5, to have the end of pin 26' slotted and a hinged gravity biased extension member 50 pivotally attached within the slot as at point 52 such that the extension member 50 can be held in alignment with the axis of the pin when the pin is passed through the respective registered aperture pair 24 and 24A in channel shaped member 16 and the bore 25A, and may thereafter pivot out of alignment when fully inserted to maintain it in position and prevent it from falling out. Such means may be used to lock the pin member in place, but the use of such locking means is not generally required. Because the pin member 26 engages the channel shaped member 16 at two different spaced locations as it passes through apertures 24 and 24A and the bore 25 the stress and shear forces acting upon the pin member 26 are distributed over a greater surface area of the pin 26 than is true of other known ladder leveling devices. This reduces the possibility of the pin shearing and therefore also increases the safety of the device. It is envisioned also that more than one pin such as the pin 26 could be used to lock the device 10 in the desired position to achieve even greater distribution of shearing forces and to further increase safety, though the use of multiple pins is usually not required. This invention is deemed to cover these and other similar embodiments.

In the preferred embodiment, as best shown in FIG. 3, the elongated channel shaped member 16 also includes a pair of other optional spaced opposed flanges 30 and 32 that project inwardly towards each other from the respective side walls 20 and 22. The flanges 30 and 32 cooperatively engage the stile 14 (or 15) to more securely embrace and hold it within the channel 17 and to provide further support for the member thereon. The flanges 30 and 32 preferrably extend the entire length of the channel shaped member 16 although they may take the form of spaced protrusions as desired. It is further envisioned that the flanges 30 and 32 could be provided with means such as threaded members which are adjustable to bear against the ladder stile to provide additional support and to make the device adaptable to be used on ladders that have stiles of different thickness. In any event the subject device is designed and constructed to be used by sliding it onto the free or distal lower end of one of the stiles 14 or 15, and it can be moved from one stile to the other by pulling the pin, removing the device, turning the device around and sliding it onto the other stile. Note also that the spacing between the flanges 30 and 32 should be selected to be wide enough to clear the ladder rungs 34 if it is made to extend to the rungs.

Figure 4:
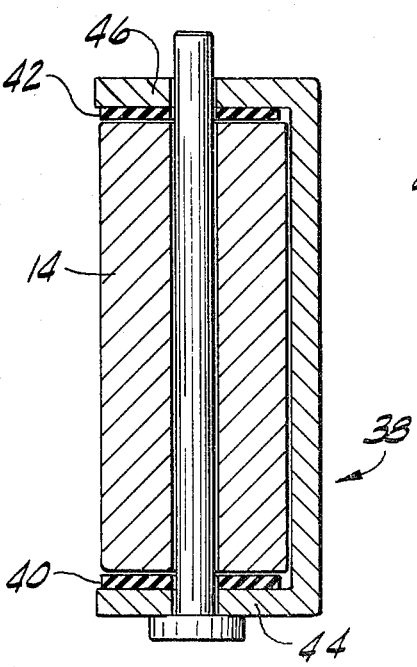
FIG. 4 is a cross-sectional view similar to FIG. 3, but showing an alternative embodiment of the subject leveling device mounted on a ladder stile.

In the construction shown in FIG. 4, the modified channel shaped member 38 is constructed so as not to include any flanges such as the flanges 30 and 32, but it does include filler material such as members 40 and 42 for frictionally engaging the stile 14. The members 40 and 42 are attached to the interior surfaces of side walls 44 and 46 respectively of channel shaped member 38. The members or strips 40 and 42 are preferrably of a high friction surface gripping material such as rubber or plastic and when used may extend the entire or less than the entire length of the channel shaped member 38. As so embodied, the member 38 can easily be installed on the stile 14 (or 15) by merely placing it on the stile, thereby eliminating the need to slide it on. It is also possible to provide surface gripping means such as the strips 40 and 42 on the embodiment of FIGS. 1–3.

Figure 6:
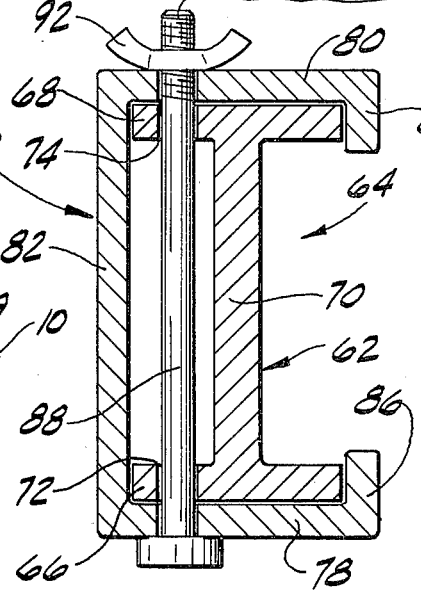
FIG. 6 is another cross-sectional view similar to FIG. 3 but showing another modified form of the subject device mounted on a metal ladder.

In FIG. 6, modified channel shaped member 60 is shown engaging a stile 62 of a metal ladder such as an aluminum ladder 64. The stiles 62 of the ladder 64 may be of I or H shaped cross section and as shown include opposite flanges 66 and 68 and a connecting member 70 extending therebetween. Other cross sectional shapes for the metal ladder can also be used including a rectangular shaped cross section and a cross section having two spaced flanges and one or more connecting members extending therebetween. In ladders particularly of metal construction a footing means, such as a hinged footing means with a resilient ground engaging surface, is often attached to the ground engaging end of each stile, and the subject channel shaped member 60 is preferably dimensioned such that it can be slipped over a ladder stile so equipped without modifying either the ladder or the subject device. In the construction shown in FIG. 6 the two spaced ladder flanges 66 and 68 have respective laterally aligned apertures 72 and 74 extending therethrough and forming a pair of stile apertures. In this construction the apertures 72 and 74 are both located on the same side of the connecting member 70 and are not centered on the ladder stiles as in the construction described above. In this construction the channel shaped member 60, similar to the channel shaped member 16 shown in FIG. 1, is movable onto a selected one of the stiles in the same manner as aforesaid, and the channel shaped member 60 is formed by two opposed side walls 78 and 80, a connecting wall 82 extending therebetween, and two opposite opposed flange portions 84 and 86 connected respectively to the opposite side walls. However, in the construction shown in FIG. 6 the aligned aperture pairs in the opposite side walls 78 and 80 of the channel shaped member 60 are located to be registrable with the off-centered stile apertures 72 and 74 as clearly shown. The construction of the channel shaped member 60 including the ground engaging end portion 27 thereof may be the same as that already described and when in use is adjusted to the desired position on the stile to compensate for irregularities or slope in the supporting surface. When so positioned a pin member such as pin 88 is positioned extending through the selected aligned aperture pair in the opposite side walls 78 and 80 of channel shaped member 60 and through the aperture pair 72 and 74 in flanges 66 and 68 of stile 62. The pin 88 has a threaded end portion 90 onto which a nut or other suitable means, such as wing-nut 92, may be threadedly positioned to maintain the parts engaged. When so constructed the device shown in FIG. 6 is operated and used in the same manner as already described. It is further envisioned that the channel shaped member 60 could be constructed to include two spaced parallel rows of longitudinally disposed apertures in each opposite side wall, one row being centered as shown in FIG. 2, and the other row off-center as to accommodate a ladder construction such as shown in FIG. 6. Other variations and combinations are also possible.

The present means and method for adjusting or leveling a ladder is both fast and efficient and requires the removal and replacement of a single pin and the relocation of the channel shaped member on the stile. The present device is also relatively simple structurally, relatively inexpensive to make and requires minimum modification of the ladder on which it is used. The combination of speed and ease of use, the fact the device can be moved from one stile to the other without modification, the simplicity of the device, and the minimum amount of modification required to be made to the ladder, all contribute to the advantages and usefulness of the device. Also, the device 10 in its preferred embodiments, can be made of relatively light weight metal, of suitable tensile strength, and it can be used on wooden as well as metal ladders.

Thus, there has been shown and described a novel device for leveling ladder rungs which fulfills all objects and advantages sought therefor. Other changes, modifications, variations, and other uses and applications of the subject device in addition to those that have been disclosed will become apparent to those skilled in the art after considering this specification and the accompanying drawing which disclose several embodiments thereof. All such changes, modifications, variations and other uses and applications which do not depart from the spirit and scope of the invention are deemed to be covered by the invention which is limited only by the claims which follow.

What is claimed is:

1. An adjustable device for leveling a ladder including a ladder having two spaced stiles connected by a plurality of spaced ladder rungs therebetween, each of said stiles having front and rear faces, a ground engaging end portion and at least one bore extending through the stile adjacent to the ground engaging lower end portion thereof and in a direction extending from the front face to the rear face, the adjustable device comprising an elongated channel shaped ladder extending member defined by two spaced opposed side walls and a connecting wall extending therebetween, said channel shaped member being of a size to cooperatively engage and embrace a selected one of the ladder stiles adjacent to the ground engaging end portion thereof to form an aligned extension of the stile, a plurality of spaced apertures in each of said opposite side walls of the channel shaped member, each of the apertures in one of said side walls being in lateral alignment with a corresponding aperture in the other of said opposite side walls to form pairs of aligned apertures, each of the said pairs of aligned apertures being selectively registrable with the bore in the stile in different positions of the channel shaped member on the stile, and a pin member insertable through a selected aperture pair on the channel shaped member and through the bore in the stile in registration therewith to hold the channel shaped member in a desired position of adjustment and extension on said stile.

2. The device defined in claim 1 including a surface gripping means pivotally attached to the elongated channel shaped member for engaging a surface on which the ladder is to be supported.

3. The device defined in claim 1 wherein a flange is attached to each of said opposite side walls of the channel shaped member, said flanges project inwardly towards each other in spaced opposed relation, said flanges cooperatively engaging the stile of a ladder extending therethrough to hold the stile therein.

4. The device defined in claim 1 including backing means attached to at least one of said spaced opposed channel walls to frictionally engage the stile extending through the channel shaped member.

5. The device defined in claim 1 including means engagable with the pin member to prevent the pin member from undesirably coming out.

6. The device defined in claim 1 wherein said ground engaging end portion of at least one of the ladder stiles includes a plurality of spaced bores extending therethrough, each of said bores being registrable with selected ones of the aperture pairs in said channel shaped member in different positions of the channel shaped member on said stile.

7. The device defined in claim 1 wherein the ladder stiles are formed of wood.

8. The device defined in claim 1 wherein the ladder stiles are formed of metal.

9. In a ladder construction having space elongated support members with opposite ends and a plurality of spaced rungs extending therebetween, one of said support members having front and rear faces and a bore therethrough adjacent to one end, the bore extending through the one support member between the front and rear faces, the improvement comprising means to adjust the position of the end of one of said support members relative to the corresponding end of the other support member to compensate for irregularities in a surface on which the ladder is supported, said means including an elongated channel shaped member having an internal cross-sectional shape which closely approximates the cross-sectional shape of the elongated support members to cooperatively engage and embrace a selected one of said support members to form an aligned extension thereof, said channel shaped member having spaced opposite front and rear wall portions, and a wall portion connected therebetween, a plurality of spaced apertures located in each of said opposed wall portions, the apertures in one of said wall portions being in alignment with corresponding apertures in the opposite wall portion to form pairs of aligned apertures therethrough, each of said pairs of the aligned apertures being individually registrable with the bore through the elongated support member in different selected positions of adjustment of the channel shaped member thereon, and a pin member extendable through a selected one of said aperture pairs and through the bore in the support member to prevent relative movement therebetween.

10. In the ladder construction defined in claim 9 the further improvement of means engagable with said pin member to prevent removal thereof from the channel shaped member.

11. In the ladder construction defined in claim 10 said means engagable with the pin member includes means hingedly attached thereto.

12. In the ladder construction defined in claim 10 said means engagable with the pin member includes means threadedly engagable therewith.

* * * * *